United States Patent [19]

Dienemann

[11] 4,086,780

[45] May 2, 1978

[54] REFRIGERATING APPARATUS, IN PARTICULAR TWO-TEMPERATURE REFRIGERATOR

[75] Inventor: Wolfgang Dienemann, Giengen, Germany

[73] Assignee: Bosch-Siemens Hausgerate GmbH, Stuttgart, Germany

[21] Appl. No.: 720,631

[22] Filed: Sep. 7, 1976

[30] Foreign Application Priority Data

Sep. 9, 1975 Germany ..... 2539914

[51] Int. Cl.[2] ..... F25B 41/00

[52] U.S. Cl. ..... 62/174; 62/155; 62/202

[58] Field of Search ..... 62/174, 234, 155, 202, 62/526

[56] References Cited

U.S. PATENT DOCUMENTS

| | | | |
|---|---|---|---|
| 3,659,430 | 5/1972 | Nichols et al. | 62/234 |
| 3,839,878 | 10/1974 | Tilmanis | 62/155 |
| 3,950,961 | 4/1976 | Lotz | 62/174 |

*Primary Examiner*—William F. O'Dea
*Attorney, Agent, or Firm*—Herbert L. Lerner

[57] ABSTRACT

A two-temperature refrigerator appliance having a refrigerator unit operated by a single compressor set, a refrigeration loop with two evaporator sections connected in series, one evaporator associated with a cold compartment and the other with a warmer compartment, a control element associated with the colder compartment disposed in the electric circuit of the compressor set, a control element associated with the warmer compartment having a constant switching-on point above the freezing point, several heating elements switched on by said warmer compartment control element with one heating element disposed adjacent a refrigerant collector connected to the refrigeration loop and another element disposed adjacent the sensor of the colder compartment control element, and at least one intermittently operated additional switching element disposed in the electric circuit of the compressor set. In the preferred form there is a double-throw switch for a defrosting heater, an on-off switch controlling the compressor set independently of the control element in the colder compartment, and a third switching member in the circuit of the double-throw switch and associated with the on-off switch whereby closing the on-off switch opens the switching member and vice versa.

7 Claims, 2 Drawing Figures

REFRIGERATING APPARATUS, IN PARTICULAR TWO-TEMPERATURE REFRIGERATOR

CROSS-REFERENCE TO RELATED APPLICATION

Application Ser. No. 655,695, entitled Refrigeration Unit, filed for Jürgen Ballarin on Feb. 6, 1976, now U.S. Pat. No. 4,033,739.

BACKGROUND OF THE INVENTION

1. Field of the Invention

This invention relates to a refrigeration appliance and more particularly refers to a new and improved two-temperature refrigerator.

2. Description of the Prior Art

In U.S. Application Serial No. 655,695 U.S. Pat. No. 4,033,739 is described a dual temperature refrigerator driven by a single compressor, having a refrigeration cycle provided with a condenser, a refrigerant metering device and refrigerant transfer lines with at least two evaporator sections connected in series with the first in a colder compartment and the second in a warmer compartment. Two separate, intermittently activated control elements; one associated with the warmer compartment turns on a heater of a refrigerant collector causing refrigerant to discharge therefrom, and thereby to fill the evaporator of the warmer compartment, the second control element associated with the colder compartment is activated by a sensor in the colder compartment and in turn activates the compressor. The first control element indirectly activates the compressor by means of a second heating element which heats the sensor which in turn activates the second control element which in turn activates the compressor.

SUMMARY OF THE INVENTION

An object of the present invention is to provide control means for a two-temperature refrigerator to effect automatic defrosting of its evaporator in the freezer compartment and efficient quick-freezing without the occurrence of harmful mutual influence on the temperature cycle in the two compartments of different temperature and with low power consumption.

With the foregoing and other objects in view there is provided in accordance with the invention a refrigeration appliance, particularly a two-temperature refrigerator, includes a refrigeration unit operated by a single compressor set energized by an electric current flowing through an electric circuit, a refrigeration loop with coolant flowing through a condenser, a refrigerant metering capillary device, refrigerant transfer lines, and two evaporator sections connected in series in the flow path of the refrigerant, the first of the two evaporator sections associated with a colder compartment and the second of the two evaporator sections associated with a warmer compartment, two separate, intermittently activated, control elements, one of the control elements associated with the warmer compartment and the other control element associated with the colder compartment, the control elements activated by the temperatures in the respective compartments, the control element associated with the colder compartment disposed in the electric circuit of the compressor set, the control element associated with the warmer compartment having a constant switching-on point above the freezing point, several heating elements switched on by the warmer compartment control element, one of the heating elements disposed adjacent a refrigerant collector to heat the refrigerant collector connected ahead of the metering capillary device of the refrigeration loop causing liquid refrigerant stored in the refrigerant collector to feed into the refrigeration loop to the first evaporator section, a second said heating element switched on by the control element of the warmer compartment is disposed adjacent to and heats a sensor of the control element in the colder compartment and thereby activates the control element of the colder compartment, and at least one additional switching element disposed in the electric circuit of the compressor set, which additional switching element operates intermittently to influence the temperature of the evaporator section associated with the colder compartment.

The control device associated with the warmer compartment has a constant switch-on point lying above the freezing point, and in the circuit of the compressor set, at least one additional switching element is disposed, through the intermittent operation of which the temperature of the evaporator section associated with the colder compartment can be influenced. It is by this means that it is possible to lower the temperature of the evaporator section associated with the colder compartment and to thereby create the conditions for quick-freezing in this compartment and to likewise defrost this evaporator section by automatically switching-on a heating element and to thereby change the temperature of the former in any way desired, without letting this raise or lower the temperature in the warmer compartment unduly.

In one embodiment of the invention, the additional switching element is a double-throw switch for a resistor which is connected parallel to the compressor set and serves as a defroster heater, so that initiating the defrosting process in the colder compartment automatically results in shutting down the compressor set.

In another embodiment of the invention the resistor serving as the defroster heater is connected in series with a thermal switch. Through this series connection, it is possible in a simple manner to automatically interrupt the defrosting process of the evaporator at a predeterminable defrosting temperature and to reliably prevent any overheating of the defrosted evaporator section. The additional switching element can be controlled automatically in a positively actuated manner. Thereby, the evaporator of the colder compartment is thawed off only when required and considerable power savings are thus achieved.

In a more specific embodiment there are several additional switching elements, the first of the additional switching elements is a double-throw switch for a heater resistor serving as a defrosting heater disposed in the colder compartment and is connected parallel to the compressor set, and the second additional switching element is an on-off switch which controls the compressor set independently of the switching state of the control element in the colder compartment, and a third switching member disposed in the circuit of the second double-throw switch and associated with the first on-off switch whereby closing the on-of switch opens the third switching member and opening the on-off switch closes the third switching member.

BRIEF DESCRIPTION OF THE DRAWINGS

Other features which are considered as characteristic for the invention are set forth in the appended claims.

Although the invention is illustrated and described herein as embodied in refrigeration appliance, particularly two-temperature refrigerator, it is nevertheless not intended to be limited to the details shown, since various modifications may be made therein without departing from the spirit of the invention and within the scope and range of equivalents of the claims.

Figure 1:
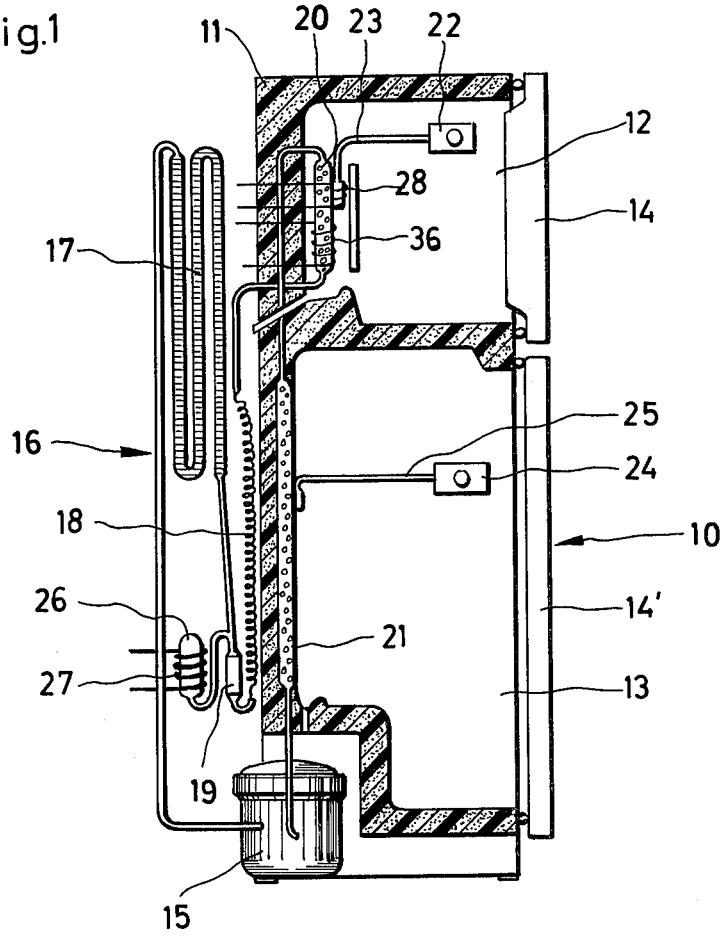
Figure 2:
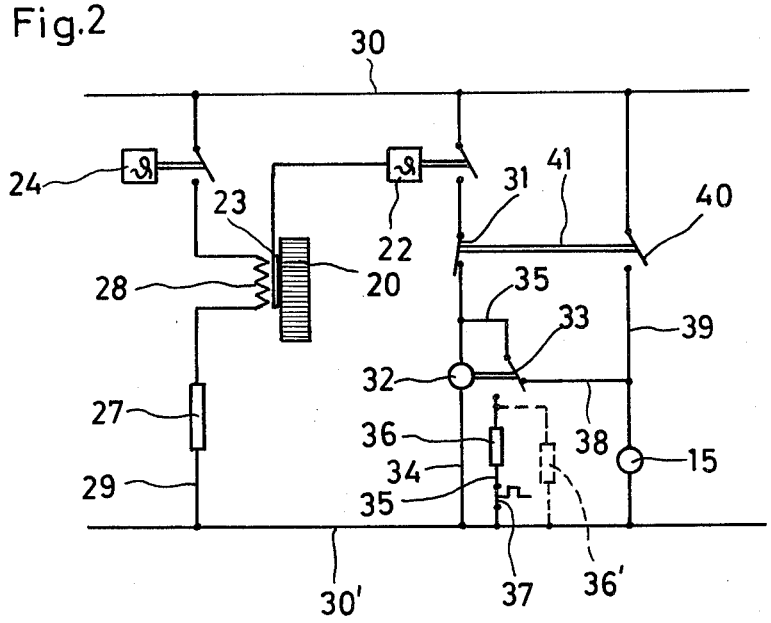

The construction and method of operation of the invention, however, together with additional objects and advantages thereof will be best understood from the following description when read in connection with the accompanying drawing, in which:

FIG. 1 is a simplified side view in partial cross-section of a two-temperature refrigerator, the refrigeration unit of which, operated by a single compressor set, has two series connected evaporator sections, of which one is associated with a freezer compartment and the other with a normal refrigeration compartment; and FIG. 2 is a simplified circuit diagram for the electrical equipment of the two-temperature refrigerator according to FIG. 1 with several additional switching elements for influencing the temperature in the freezer compartment.

DETAILED DESCRIPTION OF THE INVENTION

Referring to the drawing, a two-temperature refrigerator designated by numeral 10 as shown in FIG. 1 has heat-insulated cabinet 11, in which a freezer compartment 12 and a normal refrigeration compartment 13 are arranged on top of each other. The freezer compartment 12 has, like the normal refrigeration compartment 13, a separate heat-insulated door 14 above door 14'.

The two-temperature refrigerator 10 is equipped with a refrigeration unit 16 which is operated by a single compressor set 15. Two evaporator sections 20 and 21, series-connected in the flow path of the refrigerant, are arranged in its refrigeration loop, which comprises a condenser 17, a choke capillary or refrigerant metering capillary device 18, a drying cartridge 19 as well as various connecting lines, not specifically marked. The first evaporator section 20 is associated with the freezer compartment 12 and the second evaporator section 21 with the normal refrigeration compartment 13. Both evaporator sections are arranged here standing up, so that the melting water dripping off in the defrosting process is easier to collect and discharge. The evaporator 20 is further equipped with diaphragm baffle which prevents direct contact of the stored frozen food with this evaporator section and ensures purely convective heat transfer in the colder compartment 12.

The freezer compartment 12 is equipped with a control element or device 22 which picks up the temperature of the first evaporator section 20 associated with the freezer compartment 12 via a sensing tube 23. To this end, the end of the sensing tube 23 rests against the evaporator section 20 in good thermal contact therewith. On the other hand, a control device 24 is associated with the normal refrigeration compartment 13. The sensing tube 25 of control element or device 24 picks up the temperature prevailing at the second evaporator section 21.

The refrigeration unit 16 has a refrigerant collector 26, which is connected between the condenser 17 and the choke capillary 18 into the refrigeration loop ahead of the drying cartridge 19. Refrigerant collector 26 is equipped with a heating element 27 controlled by the control device 24 of the normal refrigeration compartment 13. A further heating element 28 which is likewise controlled by the control device 24, as will be explained later on in connection with the circuit diagram, serves for heating the end of the sensing tube 23, resting against the first evaporator section 20, of the control device 22 associated with the freezer compartment 12.

As can be seen from the circuit diagram in FIG. 2, the contacts of the control device 24 are connected in series with a heating element 27 which is intended for heating the refrigerant collector 26, as well as with the heating element 28 which heats the sensing tube 23, resting against the first evaporator section 20, of the control device associated with the freezer compartment 12. These series-connected elements are connected via a connecting line 29 to a two-pole network with the lines 30 and 30'.

The contacts of the temperature control 22 associated with the freezer compartment, on the other hand, are connected in series with a switch 31 serving as an additional switching element and with a drive motor 32 which serves to drive an automatic double-throw switch 33. The contacts of the control device 22 and of the switch 31 are connected, as is the drive motor 32, into a connecting line 34 connected to the lines 30 and 30' of the two-pole supply network. From this connecting line 34, a line 35 branches off between the switch 31 and the drive motor 32. The double-throw switch 33 as well as a heater resistor 36 and a thermal switch 37 are connected in series with line 35. The heater resistor 36, which serves as the defroster heater, as well as the thermal switch 37 are in good, heat-conducting contact with the first evaporator section 20 associated with the freezer compartment 12. One or several heater resistors 36' may also be connected parallel to the heater resistor 36 and the thermal switch 37 as indicated in FIG. 2 by dashed lines. Formation of ice is prevented in the run off for the melting water produced during the defrosting by means of heater resistors 36'.

The second contact of the double-throw switch 33 is connected to a line 38, which leads to a connecting line 39 also connected between the conductors 30 and 30' of the two-pole network. Into this connecting line 39 are connected in series the drive motor of the compressor set 15 and an on-off switch 40, and between them the line 38 is connected to the connecting line 39.

The on-off switch 40 is in effective connection with the switch 31 disposed in the connecting line 34 via an intermediate member 41 symbolically indicated in the circuit diagram shown in FIG. 2 by two parallel straight lines, so that both switches automatically open or close alternately.

The operation of the two-temperature refrigerator described above is as follows:

If, with the switch of the control device 24 open, the temperature in the freezer compartment rises above a maximum value set at the control device 22, the contacts of the control device 22 are caused to close. If at that time, the movable contacts of the switch 31 (as well as the contacts of the on-off switch 40 coupled therewith) and of the double-throw switch 33 are in the position shown in the circuit diagram as per FIG. 2, the drive motor of the compressor set 15 starts up and thereby sets the refrigeration unit 16 in operation. Due to the peculiarity of the refrigeration unit equipped with the heatable refrigerant collector 26, the volume of the refrigerant participating at first in the cooling cycle initiated thereby is merely sufficient to fill the first evaporator section 20 with liquid refrigerant. Consequently, only the freezer compartment 12 is cooled if the contacts of the control device 22 close because of a temperature rise in the freezer compartment. If in the course of the cooling cycle, the temperature in the freezer compartment 12 drops so far that the lower switching point of the control device 22 is reached, the latter switches, its contacts open and shuts off the drive motor of the compressor set 15.

If, on the other hand, the upper switching point set at the control device 24 in the normal refrigeration compartment 23 is exceeded, its contacts close and switch-on the two heating elements 27 and 28. The heating element 28 then heats up the end, resting against the first evaporator section 20, of the sensing tube 23 belonging to the control device 22. After a predetermined heating-up time, the control device 22 is thereby caused to switch, so that the circuit of the drive motor in the compressor set 15 is closed in the manner described at the outset.

Switching-on the heating element 27, which rests in good heat transfer contact against the refrigerant collector 26, has, on the other hand, the consequence that liquid refrigerant that might still be stored in this collector, is driven out into the refrigeration loop or a filling of the collector 26 with liquid refrigerant is avoided. In this manner, while the switch of the control device 24 is closed, the second evaporator section 21 associated with the normal refrigeration compartment 13 is supplied with liquid refrigerant shortly after the start of the compressor set 15. Thus liquid refrigerant is available in the second evaporator section 21 shortly after the switching of the control device 24, and cooling sets in there quickly.

After the start of the compressor set 15, initiated by the control device 23, the temperature in the normal refrigeration compartment 13 drops until the lower switching point of the control device 24 is reached and the latter's contacts are opened. This interrupts the current in the two heating elements 27 and 28 and the refrigerant colletor 26, now cooling-off, is filled again with liquid refrigerant, if the compressor set 15 continues to run because the contacts of the control device 22 in the freezer compartment 12 may then be closed. In this manner, undercooling in the normal refrigeration compartment is avoided even if the freezer compartment 12 is being cooled continuously.

If, on the other hand, the temperature prevailing in the freezer compartment 12 has dropped below the switching point set at the control device 22, the end of the sensing tube 23 resting against the first evaporator section 20 is now cooled until the contacts of the control device 22 opens and stops the drive motor of the compressor set 15. However, this is under the condition that the temperature in the freezer compartment 12 is below the lower switching point.

In the example of the two-temperature refrigerator described in the foregoing, the control device 24 of the normal refrigeration compartment 13 is designed as a so-called constant-on control, the upper switching point of which is at a fixed value above the freezing point. As a result of this, the second evaporator section 21 associated with the normal refrigeration compartment 13 is warmed up after each cooling period by absorbing heat from the environment to a temperature above the freezing point and therefore defrosts periodically, i.e., after each run of the compressor set, through natural incidence of heat and the temperature rise at the evaporator section 21 caused thereby.

The automatic defrosting of the first evaporator section 20 associated with the freezing compartment 12, on the other hand, is accomplished, with the contact of the control device 22 closed, in such a manner that the drive motor 32 switches the movable contact of the doube-throw switch 33 from the position shown into the other position. Here, the drive motor 32 of the compressor set 15 is stopped and voltage is applied to the heater resistor 36 as well as the thermal switch 37. The heat developed thereby defrosts the first evaporator section 20 quickly. The melting water produced runs off in a manner known per se via drip channels and drain openings arranged in the cabinet 11.

After the evaporator section 20 is appropriately warmed up, the thermal switch 37 opens and thereby interrupts the circuit until the drive motor 32, which continues to run also during the defrosting, switches the movable contact of the double-throw switch 33. During this defrosting period, the contacts of the control 22 remain closed due to the temperature rise at the evaporator section 20, so that the compressor set 15 starts up again immediately after the double-throw switch 33 has been switched back.

Instead of the drive motor 32, another element for automatically driving the double-throw switch can also of course, be used. Thus, one can, for example, acuate the double-throw switch 33 as a function of the frequency of opening the heat-insulating door 14 at the freezer compartment 12 or if desired in a fixed, e.g., 24-hour rhythm.

The switch 31 and the on-off switch 40 rigidly connected to it by the intermediate member 41 makes possible quick-freezing in the freezer compartment 12. This is accomplished by making the movable contacts of the on-off switch 40 close when required, whereby voltage is directly applied to the drive motor 32 of the compressor set 15. Thus, the compressor set 15 starts up independently of the position of the movable contacts of the control device 22 and the double-throw switch 33. The forced simultaneous opening of the switch 31 has the consequence that the connecting line 34 is interrupted and thereby, a simultaneous defrosting of the evaporator section 20 in the freezer compartment 12 during the quick-freezing is precluded. The quick-freezing process can also be automated in a manner known per se by building-in suitable switching elements.

If the double-throw switch 33 is in the position shown, the drive motor 32 for the double-throw switch 33 continues to run in the example of the circuit shown in FIG. 2 also during quick-freezing, although the direct power supply via the connecting line 34 is interrupted by the opening of the contact 31. In this case, the drive motor 32 is supplied via the closed on-off switch 40 in the line 39 via the lines 38, the movable contact of the double-throw switch 33, the line 35 and finally, via the line 34. The continued running of the drive motor 32 during the quick-freezing process, while it cannot initiate the defrosting process, has the advantage that no delay occurs in the next defrosting process due to the quick-freezing after the latter is completed; such delays would occur if the drive motor 32 would not continue to run during the quick-freezing. In this manner, provision is made that a defrosting process is initiated if not immediately after the quick-freezing process is completed, then at least shortly thereafter. This is of advantage particularly if the evaporator section of the freezer compartment 12 is covered with frost more quickly than usual when relatively warm and moist food to be frozen is placed in it. Connecting the heater resistor 36' serving as a drip channel heater parallel to the heater resistor 36 of the defrosting heater system and the thermal switch 37 has the advantage that voltage is applied to the heating resistor 36 also if the thermal switch 37 is open. In this manner, the drip channel is prevented from being clogged up by ice particles dropped from the evaporator section 20.

There are claimed:

1. A refrigeration appliance, particularly a two-temperature refrigerator, comprising a refrigeration unit operated by a single compressor set energized by an electric current flowing through an electric circuit, a refrigeration loop with coolant flowing through a condenser, a refrigerant metering capillary device, refrigerant transfer lines, and two evaporator sections connected in series in the flow path of the refrigerant, the first of said two evaporator sections associated with a colder compartment and the second of said two evaporator sections associated with a warmer compartment, two separate, intermittently activated, control elements, one of the control elements associated with the warmer compartment and the other control element associated with the colder compartment, said control elements activated by the temperatures in the respective compartments, said control element associated with the colder compartment disposed in the electric circuit of the compressor set, said control element associated with the warmer compartment having a constant switching-on point above the freezing point, several heating elements switched on by said warmer compartment control element, one of said heating elements disposed adjacent a refrigerant collector to heat said refrigerant collector connected ahead of the metering capillary device of the refrigeration loop causing liquid refrigerant stored in said refrigerant collector to feed into the refrigeration loop to the first evaporator section, a second said heating element switched on by the control element of the warmer compartment is disposed adjacent to and heats a sensor of the control element in the colder compartment and thereby activates the control element of the colder compartment, and at least one additional switching element disposed in the electric circuit of the compressor set, which additional switching element operates intermittently to influence the temperature of the evaporator section associated with the colder compartment.

2. A refrigeration appliance, particularly a two-temperature refrigerator, comprising a refrigeration unit operated by a single compressor set energized by an electric current flowing through an electric circuit, a refrigeration loop with coolant flowing through a condenser, a refrigerant metering capillary device, refrigerant transfer lines, and two evaporator sections connected in series in the flow path of the refrigerant, the first of said two evaporator sections associated with a colder compartment and the second of said two evaporator sections associated with a warmer compartment, two separate, intermittently activated, control elements, one of the control elements associated with the warmer compartment and the other control element associated with the colder compartment, said control elements activated by the temperatures in the respective compartments, said control element associated with the colder compartment disposed in the electric circuit of the compressor set, said control element associated with the warmer compartment having a constant switching-on point above the freezing point, several heating elements switched on by said warmer compartment control element, one of said heating elements disposed adjacent a refrigerant collector to heat said refrigerant collector connected ahead of the metering capillary device of the refrigeration loop causing liquid refrigerant stored in said refrigerant collector to feed into the refrigeration loop to the first evaporator section, a second said heating element switched on by the control element of the warmer compartment is disposed adjacent to and heats a sensor of the control element in the colder compartment and thereby activates the control element of the colder compartment, and at least one additional switching element disposed in the electric circuit of the compressor set, which additional switching element operates intermittently to influence the temperature of the evaporator section associated with the colder compartment, and wherein said additional switching element is a double-throw switch for a heater resistor connected parallel to the compressor set, said heater resistor disposed in said colder compartment serving as a defrosting heater.

3. Refrigeration applicance according to claim 2, wherein said heater resistor serving as the defrosting heater is connected in series with a thermal switch.

4. Refrigeration appliance according to claim 3, wherein another heater resistor serving as a drip channel heater is connected parallel to said heater resistor and said thermal switch.

5. Refrigeration appliance according to claim 2, including a control member to positively and automatically control said additional switching element.

6. Refrigeration appliance according to claim 1, wherein an additional switching element is an on-off switch which controls said compressor set independently of the switching state of said control element in said colder compartment.

7. A refrigeration appliance, particularly a two-temperature refrigerator, comprising a refrigeration unit operated by a single compressor set energized by an electric current flowing through an electric circuit, a refrigeration loop with coolant flowing through a condenser, a refrigerant metering capillary device, refrigerant transfer lines, and two evaporator sections connected in series in the flow path of the refrigerant, the first of said two evaporator sections associated with a colder compartment and the second of said two evaporator sections associated with a warmer compartment, two separate, intermittently activated, control elements, one of the control elements associated with the warmer compartment and the other control element associated with the colder compartment, said control elements activated by the temperatures in the respective compartments, said control element associated with the colder compartment disposed in the electric circuit of the compressor set, said control element associated with the warmer compartment having a constant switching-on point above the freezing point, several heating elements switched on by said warmer compartment control element, one of said heating elements disposed adjacent a refrigerant collector to heat said refrigerant collector connected ahead of the metering capillary device of the refrigeration loop causing liquid refrigerent stored in said refrigerant collector to feed into the refrigeration loop to the first evaporator section, a second said heating element switched on by the control element of the warmer compartment is disposed adjacent to and heats a sensor of the control element in the colder compartment and thereby activates the control element of the colder compartment, and having additional switching elements, the first of said additional switching elements is a double-throw switch for a heater resistor serving as a defrosting heater disposed in said colder compartment and is connected parallel to said compressor set, and the second additional switching element is an on-off switch which controls said compressor set independently of the switching state of said control element in said colder compartment, and a third switching member disposed in the circuit of said second double-throw switch and associated with said first on-off switch whereby closing said on-off switch opens said third switching member and opening said on-off switch closes said third switching member.

* * * * *